US005222874A

United States Patent [19]

Unnewehr et al.

[11] Patent Number: 5,222,874

[45] Date of Patent: Jun. 29, 1993

[54] LUBRICANT COOLED ELECTRIC DRIVE MOTOR FOR A COMPRESSOR

[75] Inventors: Lewis E. Unnewehr; Oleif Olsaker, both of Michigan City; John C. Shoop, LaPorte; Ray Klingler, Michigan City, all of Ind.

[73] Assignee: Sullair Corporation, Michigan City, Ind.

[21] Appl. No.: 639,489

[22] Filed: Jan. 9, 1991

[51] Int. Cl.[5] ..... F04B 17/00

[52] U.S. Cl. ..... 417/372

[58] Field of Search ..... 417/372, 369, 370; 418/DIG. 1, 99, 98

[56] References Cited

U.S. PATENT DOCUMENTS

| | | | |
|---|---|---|---|
| Re. 30,944 | 7/1989 | Shaw . | |
| 1,080,737 | 12/1913 | VerPlanck . | |
| 3,514,225 | 5/1970 | Monden et al. . | |
| 3,572,978 | 3/1971 | Scheidorf . | |
| 3,663,127 | 5/1972 | Cheers . | |
| 3,922,114 | 11/1975 | Hamilton . | |
| 4,181,474 | 1/1980 | Shaw . | |
| 4,477,233 | 10/1984 | Schaefer . | |
| 4,516,916 | 5/1985 | English et al. | 417/372 |
| 4,545,742 | 10/1985 | Shaefer | 417/372 |
| 4,645,429 | 2/1987 | Asami . | |
| 4,780,061 | 10/1988 | Butterworth . | |
| 4,802,826 | 2/1989 | Hall . | |

FOREIGN PATENT DOCUMENTS

| | | | |
|---|---|---|---|
| 663146 | 5/1963 | Canada | 418/201 |

*Primary Examiner*—Richard A. Bertsch
*Assistant Examiner*—Alfred Basichas
*Attorney, Agent, or Firm*—William D. Lanyi; Ted E. Killingsworth

[57] ABSTRACT

A combination of a variable reluctance motor and a screw compressor is provided with a fluid management system that directs a portion of the lubricant flow through the variable reluctance motor to cool its stator laminations and windings. Another portion of the lubricant flow is caused to pass directly from a heat exchanger to the screw compressor. The first portion of flow, which passes through the variable reluctance motor, is then directed into fluid communication with the inlet of the screw compressor to lubricate the screw compressor and provide cooling for the compressor. The portion of lubricant flow passing directly through the heat exchanger to the compressor also provides lubrication for the compressor and is used to further cool the moving parts of the screw compressor.

12 Claims, 2 Drawing Sheets

LUBRICANT COOLED ELECTRIC DRIVE MOTOR FOR A COMPRESSOR

BACKGROUND OF THE INVENTION

1. Field of the Invention

The present invention relates generally to a compressor that is driven by an electric motor wherein the lubricant of the compressor is used to cool the electric motor and, more specifically, to a screw compressor with a variable reluctance motor mounted above the compressor with the lubricant of the compressor being used to cool the variable reluctance motor prior to flowing into the compressor.

2. Description of the Prior Art

Many different types of motor driven compressors are known to those skilled in the art. In addition, it is also known to mount the motor vertically above the compressor.

U.S. Pat. No. 4,545,742, which issued to Schaefer on Oct. 8, 1985, describes a vertical axis helical screw compressor that is provided with a discharge gas oil mist eliminator and dual transfer tube manifold that is used for supplying liquid refrigerant and refrigerant vapor to the compression area. Refrigerant vapor discharges from the compressor through the rotor of the electric motor. This discharge is then directed toward a deflector for the purpose of causing oil mist in the discharge to adhere to the deflector and be separated from the gaseous discharge. The separated oil then drops from the deflector into the bottom of an enclosure which functions as an oil sump.

U.S. Pat. No. 1,080,737, which issued to VerPlanck on Dec. 9, 1913, discloses an internal combustion engine which utilizes water to cool the engine. It is intended for use with high compression engines. It supplies low pressure air for scavenging purpose and high pressure air for use in injecting fuel into the cylinder of the engine.

U.S. Pat. 3,514,225, which issued to Monden et al on May 26, 1970, illustrates and describes a motor driven compressor for use in a refrigeration application. It comprises a hermetically sealed casing which contains the motor compressor and a lubricant fluid. A suction cup is connected in series with a suction pipe and is maintained in heat exchange relationship with the lubricant.

U.S. Pat. No. 3,572,978, which issued to Scheidorf on Mar. 30, 1971, discloses a hermetically sealed compressor having a means for cooling a lubricant fluid. The motor is mounted above the compressor and is connected to the compressor by a vertical drive shaft. A longitudinally extending lubricant passage in the shaft is connected to a passage at the upper end of the shaft. A pump is used to provide a flow of lubricant through the longitudinal and transverse passages of the apparatus. A discharge of lubricant passes over the top of the motor and into the casing during a period of maximum flow of lubricant and on to the motor when the lubricant flow is less than its maximum. It does not utilize a screw compressor. Furthermore, it does not describe a variable reluctance motor or an apparatus in which the oil is used by the compressor.

U.S. Pat. No. 3,663,127, which issued to Cheers on May 16, 1972, describes a hermetically sealed compressor oil cooling system. The device is provided with a vertical shaft and an electric motor that is mounted above the gas pump. The end turns of the motor are disposed in a direct path of the lubricating oil which is flung from the outlet of a crankshaft oil passage that is, in turn, fed from an oil pump in the sump of the compressor. The oil is caused to flow against the main winding of the motor to cool the motor.

U.S. Pat. No. 3,922,114, which issued to Hamilton et al on Nov. 25, 1975, discloses a hermetically sealed rotor screw compressor with an improved oil management system. A two part housing is provided with a first sealed chamber and an upper chamber carrying the electric motor. It also comprises a lower chamber mounted in vertical association with the upper chamber. The discharge gas, which includes entrained oil, passes through ducts within the motor to cool the motor. The entrained oil is discharged against the upper end of a cylindrical housing to separate some of the oil from the discharge gas as a result of centrifugal force. The discharge gas is directed downwardly to further cool the motor. The oil then drains to the bottom of the enclosure which forms an oil sump.

U.S. Pat. No. 4,780,061, which issued Butterworth on Oct. 25, 1988, discloses a screw compressor that is provided with an integral oil cooling system. It includes a motor housing section and a compressor section with an oil separator downstream of the compressor discharge port. Suction gas is directed to a working chamber of the compressor so that the compressor drive motor is cooled by suction gas. Oil is directed into the passage of the motor housing heat exchange structure prior to the delivery of the oil to the compressor surfaces that require lubrication. The oil is cooled by the suction gas which passes over the surface of the heat exchanger structure.

U.S. Pat. No. 4,802,826, which issued to Hall on Feb. 7, 1989, illustrates a sealed and self contained liquid cooled gas compressor. It is completely sealed and is made up of a vertically superimposed motor and gas compressor. Heat exchanger tubes are mounted within the oil sump and in an externally mounted heat exchanger for the purpose of cooling the oil in the sump. The cooled oil is caused to continually flow over the electric motor and compressor to provide cooling and lubrication along with sealing of the compressor pistons. This device does not disclose the use of a screw compressor or the use of a variable reluctance motor. Furthermore, the oil does not flow through the inside portion of the motor and, in addition, the fluid does not leave the containment which surrounds the motor and compressor.

U.S. Pat. 4,477,233, which issued to Schaefer on Oct. 16, 1984, discloses a vertical axis screw compressor with a discharge gas oil mist eliminator and a dual transfer tube manifold for supplying liquid refrigerant and refrigerant vapor to the compression area of the compressor. It does not describe the use of a variable reluctance motor. It illustrates a hermetically sealed unit which causes oil liquid to drop down onto the stator of a motor after the oil liquid is separated from the discharge gas. The cooling of the motor occurs after the oil passes from the discharge port of the compressor.

U.S. reissue Pat. No. 30,994, which was reissued to Shaw on Jul. 13, 1982, describes a vertical axis hermetically sealed rotary helical screw compressor with an improved oil management system for its rotor bearings. It does not describe a variable reluctance motor and the oil flows to the motor after it is separated from the exhaust gas from the compressor.

U.S. Pat. No. 4,181,474, which issued to Shaw on Jan. 1, 1980, discusses a vertical axis hermetically sealed rotary helical screw compressor that is provided with a cylindrical housing that is coaxially mounted with an outer enclosure. Oil is bled from a sump and directed to the suction inlet tube of the compressor. The discharge from the compressor is directed axially downward with the lower tapered roller bearing assembly providing a minimal high pressure gap between the screw rotor ends and the stationary end plates.

U.S. Pat. 4,645,429, which issued to Asami et al on Feb. 24, 1987, describes a rotary compressor in which the discharged gas is cooled by heat dissipation through a heat exchanger after which it is again returned to the compressor. The lubricant oil is also cooled. Every component of the compressor main body and the electric motor is cooled by causing the cooled discharge gas to pass through the motor and suppress the temperature rise of the compressor.

None of the prior art devices described above teach the concept of directing cooled lubricant through the variable reluctance motor to cool its stator components prior to being directed to the inlet duct of the compressor where it acts as a lubricant for the compressor.

SUMMARY OF THE INVENTION

The present invention provides a combination of a variable reluctance motor and a rotary screw compressor in which the variable reluctance motor is mounted vertically above the screw compressor and attached in torque providing relation with one of a pair of rotors of the screw compressor. In a preferred embodiment of the present invention, the compressor apparatus comprises a rotary screw compressor that is connected to a motor which has a liquid inlet and a liquid outlet. The motor is connected in torque providing relation with the compressor and is mounted vertically above the compressor. In addition, the present invention comprises a means for providing a flow of liquid in thermal relation with the motor and, in addition, a means for directing the flow of liquid from the liquid outlet of the motor to the compressor.

In a preferred embodiment of the present invention, a means for returning the flow of fluid from the compressor to the inlet of the motor is also provided with a means for reducing the temperature of the liquid, whereby the reducing means is associated in fluid communication with the returning means.

In a highly preferred embodiment of the present invention, a variable reluctance motor is provided with a liquid inlet and a liquid outlet. A screw compressor which has a male rotor and a female rotor is connected in torque transmission with the motor, with the motor being disposed above the screw compressor. Furthermore, a means for directing a flow of liquid from the liquid outlet of the screw compressor is connected in fluid communication with the liquid outlet and a means for providing a flow of liquid to the motor is connected in fluid communication with the liquid inlet. In addition, the preferred embodiment of the present invention provides a means for returning the fluid from the screw compressor to the inlet after the liquid passes through the screw compressor. It further comprises a means for directing the liquid into thermal communication with an outer cylindrical surface of the stator core of a variable reluctance motor and a means for spraying a portion of the liquid onto the stator coil of the motor. External to the motor and compressor, a means for reducing the temperature of the liquid is provided and is connected in fluid communication with an outlet of the compressor and also with a liquid inlet of the motor. An oil separator is connected in fluid communication with a gas outlet of the screw compressor and the oil which is separated from the gaseous discharge of the compressor is directed in fluid communication with the temperature reducing means. A means is also provided for separating a flow of liquid from the reducing means into a first stream and a second stream, whereby the first stream is directed toward the liquid inlet of the motor and the second stream is directed toward the screw compressor.

BRIEF DESCRIPTION OF THE DRAWING

The present invention will be more fully understood from a reading of the description of the preferred embodiment. In conjunction with the drawing, in which.

DESCRIPTION OF THE PREFERRED EMBODIMENT

Figure 1:
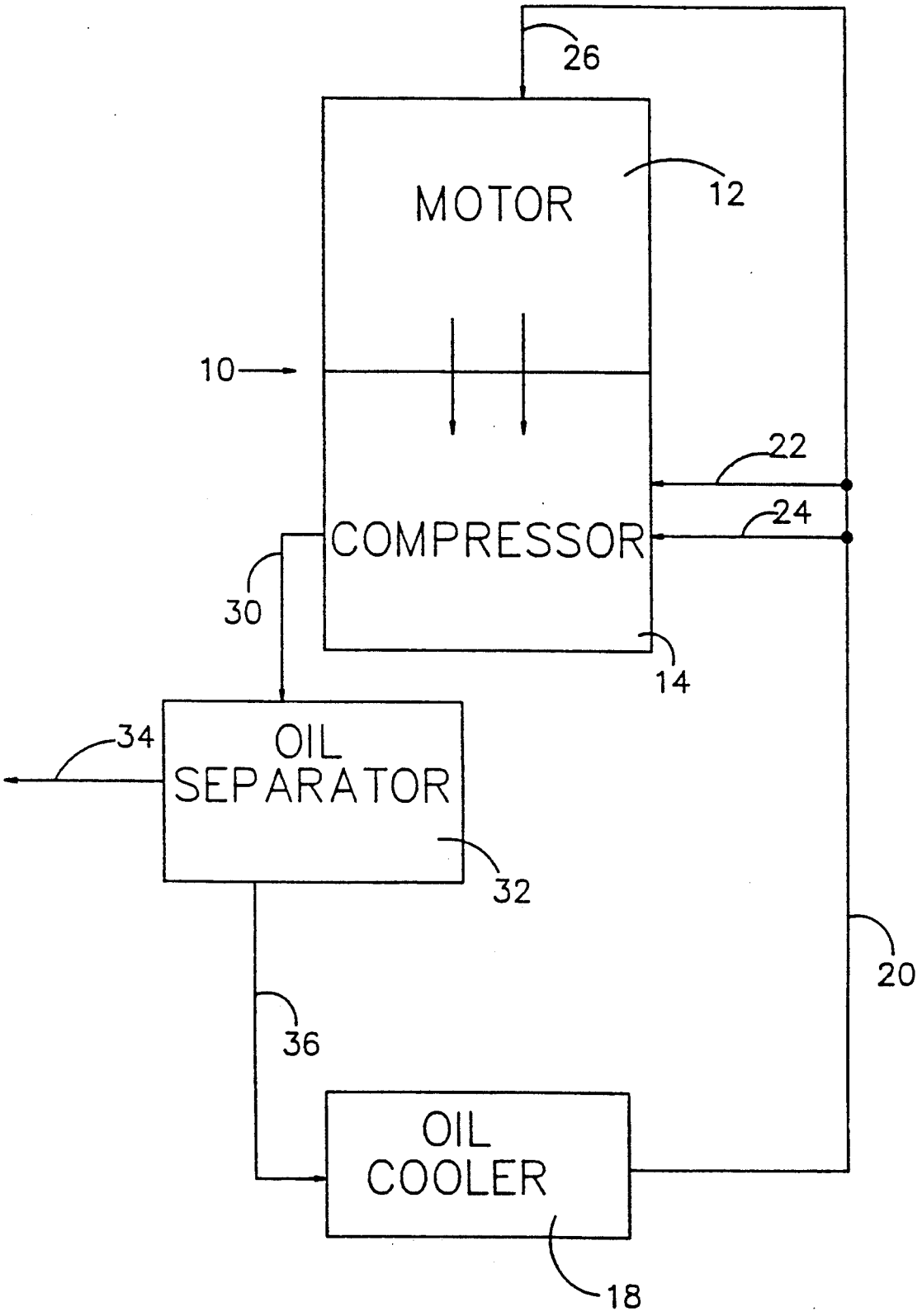
FIG. 1 illustrates a schematic diagram of the present invention, with its motor and compressor, connected in fluid communication with an oil separator and an oil cooler.

Throughout the description of the preferred embodiment, like reference numerals will be used to describe like components.

In FIG. 1, reference numeral 10 is used to identify the combination of the motor 12 and the compressor 14 of the present invention. Although FIG. 1 is illustrated in a highly schematic format, it should be noted that the motor 12 is mounted vertically above the compressor 14 so that gravity can be used to aid the fluid flow through both components.

An oil cooler 18 is used to reduce the temperature of the liquid oil flowing within the system. The cooled oil flowing from the oil cooler 18 passes through a conduit 20, as illustrated. Conduit 20 is connected in fluid communication with three other conduits, 22, 24, and 26. Conduits 22 and 24 direct a flow of cooled liquid lubricant directly to the compressor. The lubricant flowing through conduits 22 and 24 is intentionally directed to bypass the motor 12 and flow directly to the compressor without passing in thermal communication with the motor 12. The lubricant passing through conduit 26 flows to the motor for the purpose of cooling the internal components of the motor as will be described in greater detail below in conjunction with FIG. 2. The lubricant that passes through line 22 is directed to flow into the compressor and, more specifically, into thermal communication with the gas that is being compressed. It then lowers the temperature of the gas which has been elevated because of the heat of compression. This same lubricant, which flows through line 22, also seals the clearance existing between each rotor and the housing and between the rotors themselves. The lubricant also lubricates the rolling and sliding function within the compressor. The fluid flowing through line 24 provides lubricant for the bearings.

The discharge of the compressor 14 contains a high pressure gas with lubricant mist entrained within the gaseous discharge. That high pressure gas, with its entrained lubricant mist, is directed through conduit 30 to an oil separator 32. The oil separator 32 is constructed in a manner which is well known to those skilled in the art. In addition, it should be clearly understood that any type of effective oil separator can be used in association with the present invention. The oil separator removes the entrained lubricant mist from the gaseous discharge of the compressor and directs the oil free gas output through conduit 34 for use by the compressed gas system. The lubricant liquid which is removed from the compressor discharge is directed through conduit 36 to the oil cooler 18 for the purpose of reducing its temperature prior to directing the liquid through conduit 20 to again circulate through the system as described above. It should be understood that the oil cooler 18 can be any type of effective heat exchanger that reduces the temperature of the oil.

Figure 2:
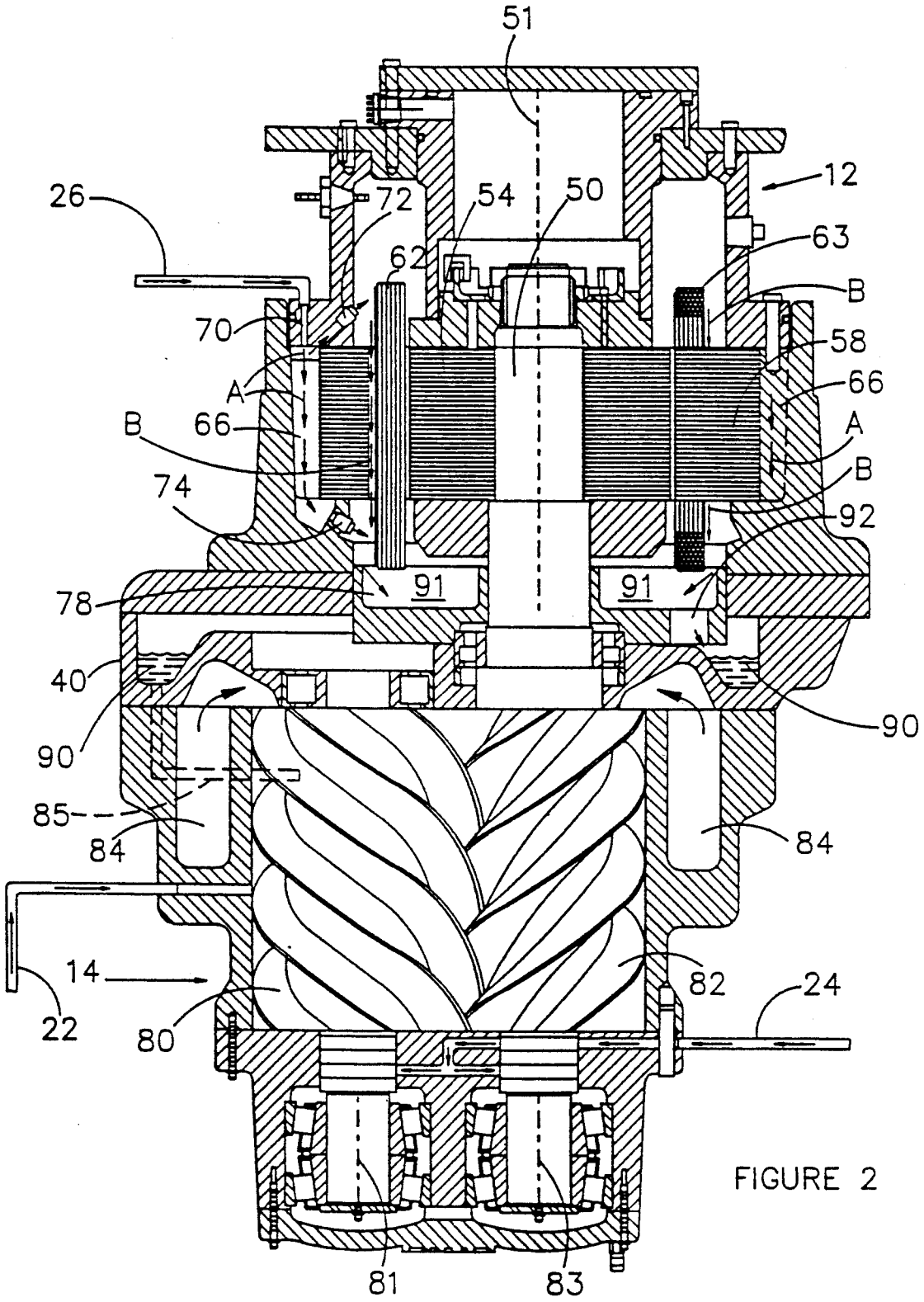
FIG. 2 illustrates a sectional view of the variable reluctance motor of the present invention connected to a rotary screw compressor with an adapter section disposed therebetween.

FIG. 2 shows a sectional view of the present invention with the motor 12 being mounted vertically above the compressor 14. Between the motor 12 and the compressor 14, an adapter section 40 is used to provide fluid communication between appropriate portions of both the motor 12 and the compressor 14.

The motor 12 is a variable reluctance motor which comprises a rotor shaft 50 on which a plurality of rotor laminations 54 are mounted. The rotor shaft 50 is mounted in the variable reluctance motor to rotate about its axis of rotation 51. The rotor of the variable reluctance motor 12, with its shaft 50 and rotor laminations 54, are disposed in concentric and coaxial relation with a stator core 58 which also comprises a plurality of laminations as shown in FIG. 2. The stator of the variable reluctance motor 12 is provided with stator windings to form a plurality of stator poles. In FIG. 2, two windings, 62 and 63, are illustrated for purposes of this discussion. However, it should be understood that other stator windings are disposed in a generally circular pattern around axis 51 and arranged in association with slots in the laminations of the stator 58. Space is provided around the outer cylindrical surface of the stator laminations 58. In FIG. 2, this space is identified by reference numeral 66 and comprises an open volume surrounding the stator core.

It should be understood that the sectional view of FIG. 2 is taken through a section that is not defined by a flat plane but, instead, is a 90° section used for the purpose of showing different portions of the stator which are not diametrically opposed to each other. A passage 70 is provided to accept an inflow of oil such as that which would be provided through conduit 26. The oil flows through passage 70 into the space 66 that is disposed radially outward from the outer cylindrical surface of the stator core.

The oil flows through passage 70, as illustrated by arrows A, and generally fills the space 66 adjacent the laminations of the stator 58. The liquid lubricant which flows into space 66 has been first cooled by the oil cooler 18 in FIG. 1 and is provided under pressure through conduit 26 and passage 70. Although only one passage 70 is illustrated in FIG. 2, and a preferred embodiment of the present invention actually utilizes only one single passage 70 it should be clearly understood that a plurality of similar passages could possibly be arranged around the periphery of the motor to direct a plurality of streams of lubricant downward into space 66. Since the lubricant in space 66 is under pressure, it is caused to flow through nozzles 72 and 74. Although only one example of each of these two nozzles is shown in FIG. 2, it should be understood that a plurality of these nozzles is arranged around the centerline 51 of the rotor and directed to spray lubricant in fluid communication and in thermal communication with the end windings of each of the stator windings which are illustrated by the examples identified by reference numerals 62 and 63. Each of the plurality of stator windings is disposed in fluid and thermal communication with lubricant spray that passes through nozzles similar to those identified by reference numerals 72 and 74. After passing through nozzles 72 and 74, the lubricant flows against the windings of the stator and, due to the effect of gravity, flows downward along the stator windings as indicated by arrows B. Since the slots in the laminations 58 of the stator are generally rectangular while the windings, such as 62 and 63, are not defined by rigidly straight lines, spaces exist between the windings and the walls of the stator slots. This permits some of the oil to flow in the direction indicated by arrows B in FIG. 2. The flow of lubricant in thermal communication with both the stator laminations and the stator windings, as illustrated by 62 and 63, reduces the temperature of the stator components.

After passing in thermal communication with the stator components, the lubricant flows into the annular region identified by reference numeral 91. A plurality of openings, such as that identified by reference numeral 92, permit the lubricant to flow into an oval shaped opening in the adapter section 40 to form a pool that is identified by reference numeral 90 in FIG. 2.

The rotary screw compressor 14 is provided with a first rotor 80 and a second rotor 82. The second, or male, rotor 82 is shown being disposed in torque transmission relation with the shaft 50 of the rotor of the variable reluctance motor 12. However, it should be understood that in some circumstances, it may be desirable to connect the rotor shaft 50 to the second rotor 82 through a gear transmission. Also, it should be understood that the first, or female, rotor 80 could be driven directly by the rotor shaft 50. In a preferred embodiment of the present invention, the rotor shaft 50 is connected directly to the second rotor 82 without intermediate gearing since the variable reluctance motor can operate at a virtually infinite number of rotational speeds. The first rotor 80 is supported for rotation about a central axis of rotation 81 and the second rotor 82 is supported for rotation about a central axis of rotation 83. Appropriate bearings are provided to support both the first 80 and second 82 rotors within the housing structure of the screw compressor 14.

An generally oval shaped chamber 84 is used to introduce a volume of gas at a relatively low pressure, such as atmospheric pressure, into the inlet of the screw compressor. This chamber 84 does not extend completely around the compressor but, instead, provides an inlet space that extends partially around the compressor. Because of the particular section view of FIG. 2, the compressor suction inlet is not shown. Lubricant from the pool 90 is directed into fluid communication with the inlet of the compressor 14 as represented by channel 85 that is formed in the housing of the compressor and provides lubrication that is required by the screw compressor. Not all of the lubricant provided to the screw compressor 14 is provided from the pool 90. It should be understood that only a portion of the lubricant flows through the variable reluctance motor 12 prior to flowing through the screw compressor. That portion of the lubricant flow cools the stator laminations 58 and stator coils of the variable reluctance motor prior to providing lubrication for the screw compressor. Additional lubricant flow is caused to bypass the variable reluctance motor 12 and flow directly into the compressor 14. The portion of the oil flow from the oil cooler 18 in FIG. 1 which is caused to bypass the motor 12 and flow through conduits 22 and 24 is directed, as illustrated in FIG. 2, to the compression chamber of the compressor 14 and the bearings of the first 80 and second 82 rotors. The oil flowing through conduit 22 is directed through an opening in the housing of the compressor 14 and into fluid communication with a preselected location of the compression chamber. The lubricant passing through conduit 22 reduces the temperature of the gas which is being compressed by the female 80 and male 82 rotors. Because of the heat of compression, the temperature of the gas rises as it passes from the suction inlet of the compressor, located proximate the upper portion of the compressor in FIG. 2 but not specifically illustrated, and the discharge of the compressor, which is located at the bottom of the compressor in FIG. 2 but not specifically illustrated. The fluid flowing through conduit 24 is directed, through channels formed in the housing of the compressor, to the bearings which support the male and female rotors for rotation.

While the present invention is shown in FIG. 1 connected in association with an oil separator 32 and an oil cooler 18, it should be understood that those components are not a required integral portion of the present invention. In addition, it should be understood that the present invention comprises the motor 12 and the compressor 14 which are not arranged hermetically but, instead, are connected in fluid communication with both the oil cooler 18 and the oil separator 32. Oil is cooled by one or more external heat exchange devices and the liquid lubricant is separated from the gaseous output by one or more oil separators. It should also be understood that the lubricant passing through conduit 26 flows through the motor 12 prior to flowing into the compressor 14. This permits the motor 12 to be cooled by a lubricant flow which has been cooled in the oil cooler 18. It should also be understood that all of the lubricant does not pass through the variable reluctance motor prior to passing into the compressor. Some of the lubricant is directed through conduits 22 and 24 to flow directly from the oil cooler 18 to the compressor. In addition, it should be understood that the vertical mounting of the variable reluctance motor above the compressor permits the present invention to utilize the advantageous effects of gravity to assist in the fluid management of the lubricant for the purpose of reducing the power requirement that would otherwise be needed to cause the appropriate flow of lubricant through the motor and compressor. Neither liquid nor gas is directed upward through either the rotor or any other component of the motor.

Although the present invention has been described in particular detail and illustrated with significant specificity, it should be clearly understood that alternative embodiments of the present invention should be considered within its scope.

What we claim is:

1. A compressor apparatus, comprising:

a screw compressor having a male rotor, a female rotor and an outlet for supplying compressed gas for a gas system;

a variable reluctance motor having a rotor member and a stator member, said variable reluctance motor having an elevated liquid inlet and a lower liquid outlet, said variable reluctance motor being connected in torque providing relation with said screw compressor, said variable reluctance motor being disposed above said screw compressor;

means connected in fluid communication with said liquid inlet for providing a flow of liquid in thermal relation with the stator of said variable reluctance motor;

means for directing said flow of liquid from said liquid outlet of said motor to said screw compressor rotors;

an oil separator connected in fluid communication with a gas outlet of said screw compressor, said oil separator having a liquid outlet;

means for reducing the temperature of said liquid, said reducing means being associated in fluid communication with said separator outlet; and means for returning liquid from said reducing means to said inlet of said variable reluctance motor.

2. The apparatus of claim 1, further comprising:

means for causing said liquid from the liquid inlet of the motor to be sprayed onto stator windings of said variable reluctance motor.

3. The apparatus of claim 1, further comprising:

means for directing said liquid from the liquid inlet of the motor into thermal communication with a stator core of said variable reluctance motor.

4. The apparatus of claim 1, further comprising:

means for directing a first portion of said liquid from said reducing means directly into said compressor and means for directing a second portion of said liquid from said reducing means into said liquid inlet of said motor.

5. The apparatus of claim 1, wherein:

a housing structure of said motor is rigidly attached to a housing structure of said compressor.

6. The apparatus of claim 1, further comprising:

an adapter plate disposed between said motor and said compressor.

7. A compressor apparatus, comprising:

a motor having a liquid inlet and a liquid outlet;

a screw compressor having a male rotor and a female rotor, said screw compressor being connected in torque transmission with said motor, said motor being attached to said screw compressor, said motor being disposed above said screw compressor;

means connected in fluid communication with said liquid outlet for directing a flow of liquid from said liquid outlet to said screw compressor;

means connected in fluid communication with said liquid inlet for providing a flow of said liquid to said motor;

means for returning said fluid from said screw compressor to said liquid inlet after said liquid passes through said screw compressor;

means for directing said liquid into thermal communication with an outer cylindrical surface of a stator core of said motor;

means for spraying a flow of said liquid onto a stator coil of said stator of said motor;

means for reducing the temperature of said liquid, said reducing means being connected in fluid communication with an outlet of said compressor and in fluid communication with said liquid inlet of said motor;

an oil separator connected in fluid communication with a gas outlet of said screw compressor, said oil separator having a liquid outlet connected in fluid communication with said reducing means; and means for separating a flow of liquid flowing form said reducing means into a first stream and a second stream, said first stream being directed toward said liquid inlet of said motor, said second stream being directed toward said screw compressor.

8. A gas compressor apparatus, comprising:

a screw compressor having intermeshing rotors mounted for rotation on parallel axes in a compressor housing;

an inlet to the compressor housing for introducing gas into an inlet area of the rotors;

an outlet from the compressor housing for discharging gas from an outlet area of the rotors for a compressed gas system;

an electric variable reluctance motor having a housing mounted above the compressor housing;

said motor having a stator mounted in the motor housing and a rotor connected in driving relationship with one of the compressor rotors;

an inlet to the motor housing near the top of such housing for introducing liquid for cooling the motor stator;

an outlet from the motor housing near the bottom of such housing for discharging liquid from the motor housing;

an inlet to the compressor housing connected for introducing liquid from the motor housing outlet into the rotors in the compressor housing;

a separator communicating with the compressor outlet for separating liquid from the gas and discharging separated gas to a compressed air system;

an outlet from the separator for discharging separated liquid;

conduit means for supplying separated liquid from the separator to the motor housing inlet; and conduit means for conducting cooling liquid from the inlet of the motor housing to the stator and then to the outlet from the motor housing.

9. A gas compressor apparatus as defined in claim 8, wherein the last recited conduit means comprises conduit means for conducting cooling liquid from the inlet of the motor housing around the outside of the stator.

10. A gas compressor apparatus as defined in claim 8, wherein the last recited conduit means comprises spray means for directing cooling liquid from the inlet of the motor housing to the stator windings.

11. A gas compressor apparatus as defined in claim 8, where the last recited conduit means comprises conduit means for conducting cooling liquid from the windings along inner core areas of the stator.

12. A gas compressor apparatus, comprising:

a screw compressor having intermeshing rotors mounted for rotation on parallel axes in a compressor housing;

an inlet to the compressor housing for introducing gas at atmospheric pressure into an inlet area of the rotors;

an outlet from the compressor housing for discharging gas at high pressure from an outlet area of the rotors for a compressed gas system;

an electric variable reluctance motor having a housing mounted above the compressor housing;

said motor having a stationary stator element mounted in the motor housing with electrical windings thereon and a rotary rotor element connected in driving relationship with one of the compressor rotors;

an inlet to the motor housing near the top of such housing for introducing a coolant and lubricant liquid for cooling the motor stator and its windings;

an outlet from the motor housing near the bottom of such housing for discharging liquid from the motor housing;

an inlet to the compressor housing connected for introducing liquid from the motor housing outlet into an inlet area of the rotors in the compressor housing;

a separator communicating with the compressor outlet for separating liquid from gas and discharging separated gas for a compressed air system;

an outlet from the separator for discharging separated liquid;

a cooler communicating with the liquid outlet from the separator for cooling separated liquid;

conduit means for supplying cooled liquid from the cooler to the motor housing inlet;

conduit means for supplying cooled liquid from the cooler to the compressor rotors at a position intermediate the inlet area and outlet area;

conduit means for conducting cooling liquid from the inlet of the motor housing around the outside of the stator;

spray means for directing cooling liquid from the inlet of the motor housing to the stator windings; and conduit means for conducting cooling fluid from the windings along inner core areas of the stator.

* * * * *